US007121170B2

(12) United States Patent
Shen

(10) Patent No.: US 7,121,170 B2
(45) **Date of Patent: *Oct. 17, 2006**

(54) RATCHET WRENCH OPERATED CONVENIENTLY

(75) Inventor: Rui-Chi Shen, Taichung Hsien (TW)

(73) Assignee: Stanley Chiro International, Ltd., (TW)

( * ) Notice: Subject to any disclaimer, the term of this patent is extended or adjusted under 35 U.S.C. 154(b) by 63 days.

This patent is subject to a terminal disclaimer.

(21) Appl. No.: 10/828,315

(22) Filed: Apr. 21, 2004

(65) Prior Publication Data

US 2005/0235783 A1 Oct. 27, 2005

(51) Int. Cl.
*B25B 13/46* (2006.01)
*B25B 13/00* (2006.01)

(52) U.S. Cl. ..... 81/63.2; 81/58; 81/60; 81/61; 81/62; 81/63; 81/63.1

(58) Field of Classification Search ..... 81/58, 81/60–63.2; 192/43.1, 43.2
See application file for complete search history.

(56) References Cited

U.S. PATENT DOCUMENTS 4,561,329 A * 12/1985 Lack ..... 81/62
6,845,691 B1 * 1/2005 Hsien ..... 81/60
2005/0145075 A1 * 7/2005 Lee et al. ..... 81/63.2

* cited by examiner

*Primary Examiner*—Lee D. Wilson
*Assistant Examiner*—Bryan Muller
(74) *Attorney, Agent, or Firm*—Bacon & Thomas PLLC

(57) ABSTRACT

A ratchet wrench includes a handle, a drive head, a ratchet wheel, a pawl member, a control knob, a positioning plate, and an urging spring. Thus, the ratchet wrench includes a positioning plate to push the pawl member, thereby reducing the volume of the ratchet wrench efficiently. In addition, the urging spring is supported and guided by the guide shaft of the positioning plate, so that the positioning plate is not easily deformed, thereby facilitating movement of the urging spring in the positioning plate.

9 Claims, 8 Drawing Sheets

RATCHET WRENCH OPERATED CONVENIENTLY

BACKGROUND OF THE INVENTION

1. Field of the Invention

The present invention relates to a ratchet wrench, and more particularly to a ratchet wrench, wherein the urging spring is supported and guided by the guide shaft of the positioning plate, thereby facilitating operation of the ratchet wrench.

2. Description of the Related Art

A conventional ratchet wrench in accordance with the prior art shown in FIGS. 1 and 2 comprises a handle 10, a drive head 15 mounted on a distal end of the handle 10 and having a first end formed with a receiving hole 16, a mediate portion formed with a receiving recess 17 communicating with the receiving hole 16, and a second end formed with a receiving chamber 18 communicating with the receiving recess 17, a ratchet wheel 20 mounted in the receiving hole 16 of the drive head 15 by a C-shaped snap 22 and having a periphery formed with a plurality of ratchet teeth 21, a pawl member 23 pivotally mounted in the receiving recess 17 of the drive head 15 and having a first side formed with a plurality of engaging teeth 24 engaged with the ratchet teeth 21 of the ratchet wheel 20 and a second side formed with an positioning edge 25, and a control knob 26 rotatably mounted in the receiving chamber 18 of the drive head 15 and formed with a hole 27 for receiving a spring 28 which is biased by an urging pin 29 which is urged on the positioning edge 25 of the pawl member 23 to push the pawl member 23 to press the ratchet wheel 20 to control the drive direction of the ratchet wheel 20. Thus, by rotation of the control knob 26, the ratchet wheel 20 is rotated in one direction only when the drive head 15 is rotated.

However, the conventional ratchet wrench needs a larger space to receive the urging pin 29, thereby increasing the volume of the ratchet wrench efficiently. In addition, the spring 28 is not supported by the control knob 26 efficiently, so that operation of the conventional ratchet wrench is not smooth and conveniently.

SUMMARY OF THE INVENTION

The present invention is to mitigate and/or obviate the disadvantage of the conventional ratchet wrench.

The primary objective of the present invention is to provide a ratchet wrench having including a positioning plate to push the pawl member, thereby reducing the volume of the ratchet wrench efficiently.

Another objective of the present invention is to provide a ratchet wrench, wherein the urging spring is supported and guided by the guide shaft of the positioning plate, so that the positioning plate is not easily deformed, thereby facilitating movement of the urging spring in the positioning plate.

A further objective of the present invention is to provide a ratchet wrench that only needs to provide a limit spring to position the control knob rigidly and stably, so that the ratchet wrench has a simplified construction, thereby decreasing costs of fabrication.

A further objective of the present invention is to provide a ratchet wrench, wherein the positioning plate is urged on the positioning edge of the pawl member rigidly and stably so as to position the pawl member exactly.

A further objective of the present invention is to provide a ratchet wrench, wherein the control knob is rigidly and stably positioned in the receiving chamber of the drive head by the limit spring, thereby facilitating a user operating the control knob.

In accordance with the present invention, there is provided a ratchet wrench, comprising:

a handle;

a drive head mounted on an end of the handle and having a first end formed with a receiving hole, a mediate portion formed with a receiving recess communicating with the receiving hole, and a second end formed with a receiving chamber communicating with the receiving recess;

a ratchet wheel mounted in the receiving hole of the drive head;

a pawl member pivotally mounted in the receiving recess of the drive head and engaged with the ratchet wheel;

a control knob rotatably mounted in the receiving chamber of the drive head and having an inside formed with a passage radially extended through the control knob;

a positioning plate mounted in the passage of the control knob and having a first end rested on the pawl member to push the pawl member to press the ratchet wheel; and an urging spring mounted on a second end of the positioning plate and urged between the positioning plate and the drive head.

Further benefits and advantages of the present invention will become apparent after a careful reading of the detailed description with appropriate reference to the accompanying drawings.

DETAILED DESCRIPTION OF THE INVENTION

Figure 1:
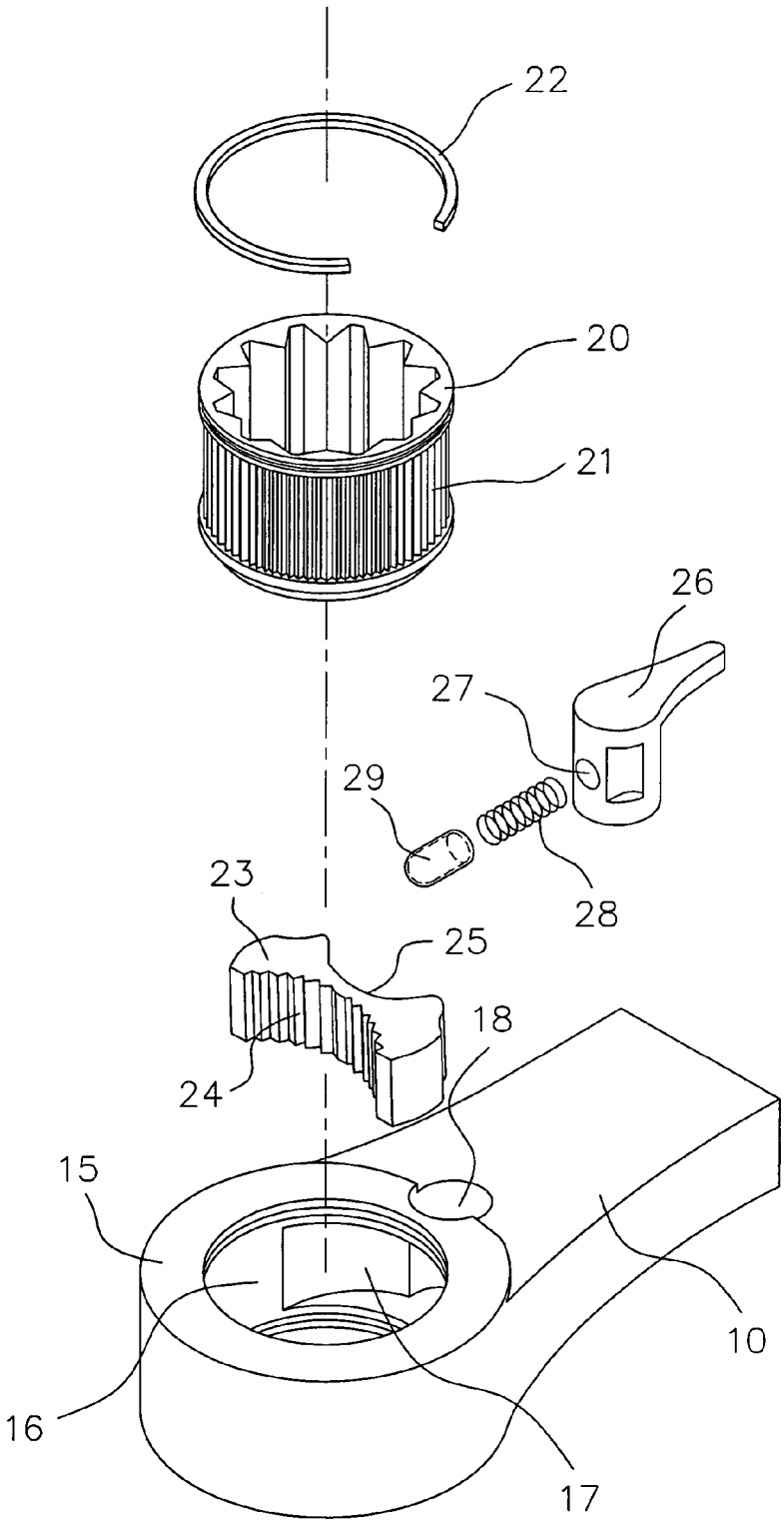
FIG.1 PRIOR ART
FIG. 1 is a partially cut-away exploded perspective view of a conventional ratchet wrench in accordance with the prior art.
Figure 2:
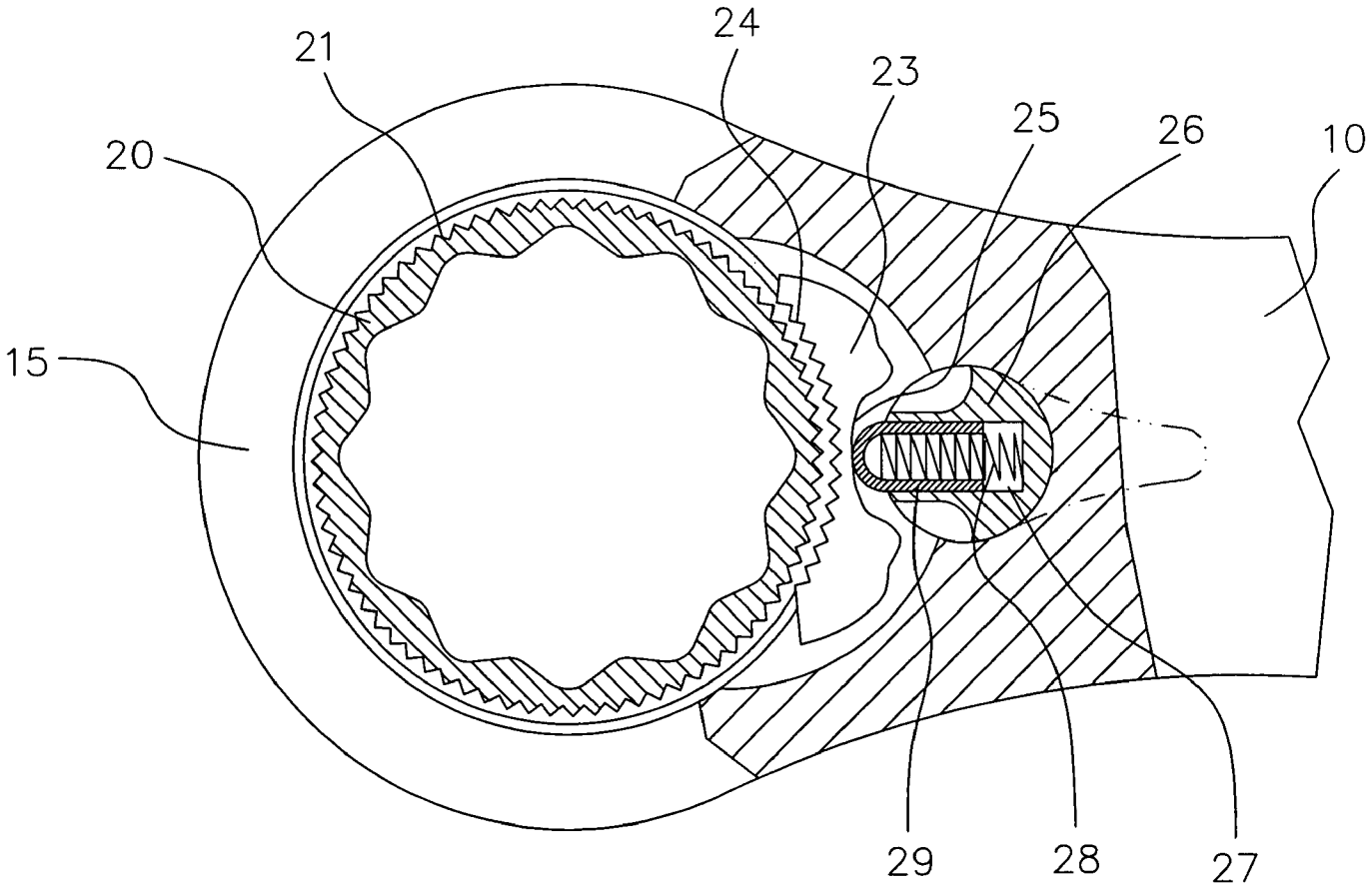
FIG. 2 PRIOR ART
FIG. 2 is a top plan cross-sectional assembly view of the conventional ratchet wrench as shown in FIG. 1.

Referring to the drawings and initially to FIGS. 3-6, a ratchet wrench in accordance with the preferred embodiment of the present invention comprises a handle 50, a drive head 51 mounted on an end of the handle 50 and having a first end formed with a receiving hole 52, a mediate portion formed with a receiving recess 53 communicating with the receiving hole 52, and a second end formed with a receiving chamber 54 communicating with the receiving recess 53, a ratchet wheel 60 mounted in the receiving hole 52 of the drive head 51, a pawl member 65 pivotally mounted in the receiving recess 53 of the drive head 51 and engaged with the ratchet wheel 60, and a control knob 70 rotatably mounted in the receiving chamber 54 of the drive head 51 and rested on the pawl member 65 to push the pawl member 65 to press the ratchet wheel 60 to control the drive direction of the ratchet wheel 60. The above-mentioned structure and manner of operation are conventional and will not be further described in detail.

The ratchet wheel 60 is a substantially T-shaped socket. The ratchet wheel 60 has a periphery formed with a plurality of ratchet teeth 61 and has a bottom formed with an annular groove 62 for fixing a C-shaped snap ring 63 which is rested on a bottom of the drive head 51 to secure the ratchet wheel 60 on the drive head 51.

The pawl member 65 has a first side formed with a plurality of engaging teeth 66 engaged with the ratchet teeth 61 of the ratchet wheel 60 and a second side formed with an arcuate positioning edge 67.

The control knob 70 has an inside formed with a passage 71 radially extended through the control knob 70 and aligned with the positioning edge 67 of the pawl member 65. The control knob 70 has a periphery formed with an annular snap groove 72. Preferably, the snap groove 72 of the control knob 70 is located under and communicated with the passage 71. The control knob 70 has a first end formed with a drive handle 74 protruding outward from the drive head 51 and a second end formed with an enlarged resting plate 79 located adjacent to the snap groove 72.

A substantially C-shaped limit spring 73 is mounted in the snap groove 72 of the control knob 70 to rotate with the control knob 70 and is rested on the resting plate 79 of the control knob 70. The limit spring 73 has a mediate portion formed with a substantially U-shaped insertion portion 730 inserted into the passage 71 of the control knob 70 and two distal ends each formed with an arc-shaped protruding locking portion 732 to position the control knob 70 on the drive head 51 rigidly and stably.

Figure 4:
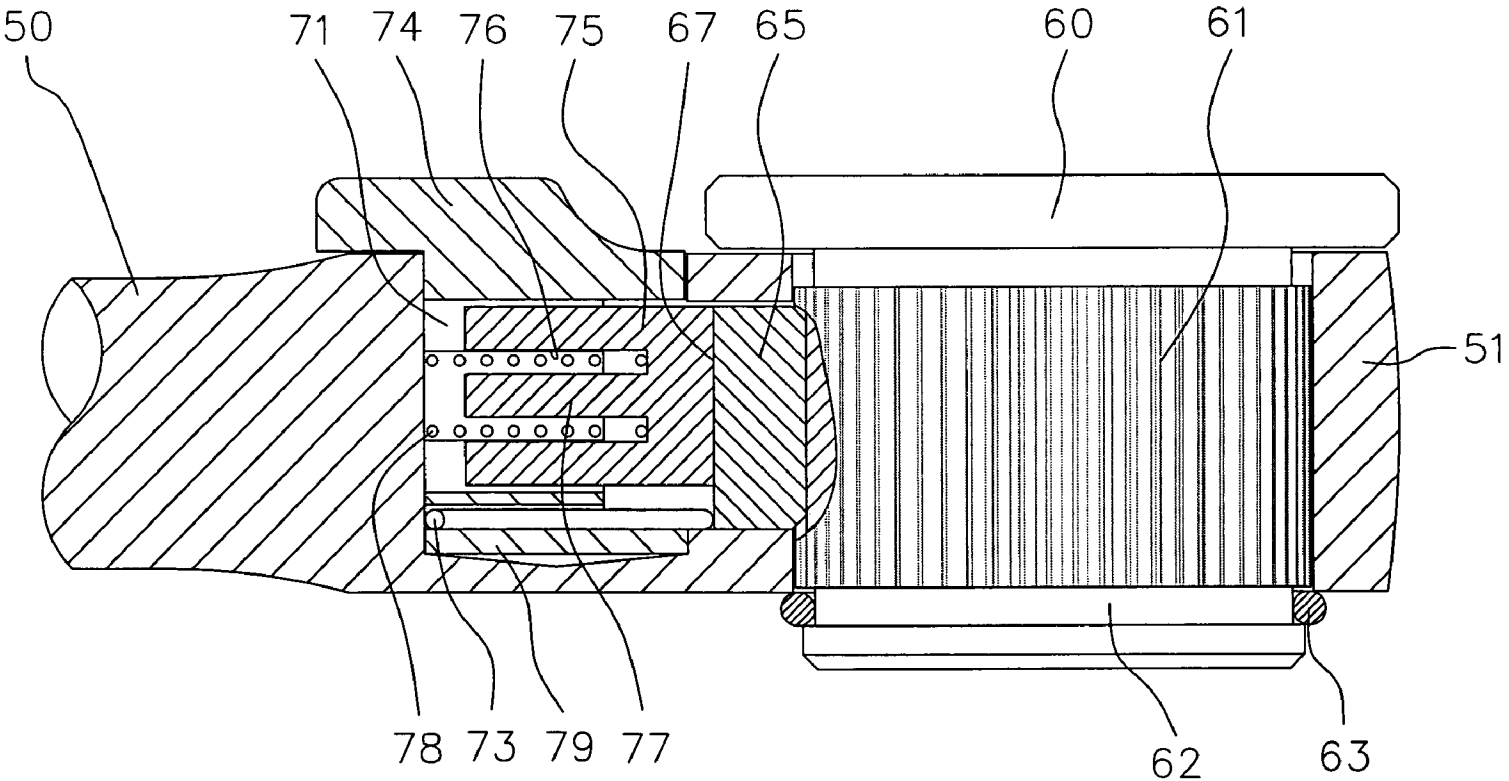
FIG. 4 is a partially cut-away plan cross-sectional assembly view of the ratchet wrench as shown in FIG. 3.

A substantially E-shaped positioning plate 75 is mounted in the passage 71 of the control knob 70 and has a first end rested on the positioning edge 67 of the pawl member 65. An urging spring 78 is mounted on a second end of the positioning plate 75 and urged between the positioning plate 75 and the drive head 51, so that the positioning plate 75 is urged on the positioning edge 67 of the pawl member 65 rigidly and stably as shown in FIG. 4 so as to position the pawl member 65 exactly. The second end of the positioning plate 75 is formed with two slits 76 and a guide shaft 77 located between the two slits 76, and the urging spring 78 is mounted on the guide shaft 77 and located between the two slits 76. Thus, the urging spring 78 is supported and guided by the guide shaft 77 of the positioning plate 75, so that the positioning plate 75 is not easily deformed, thereby facilitating movement of the urging spring 78 in the positioning plate 75. In addition, the positioning plate 75 has a bottom rested on the insertion portion 730 of the limit spring 73.

Figure 3:
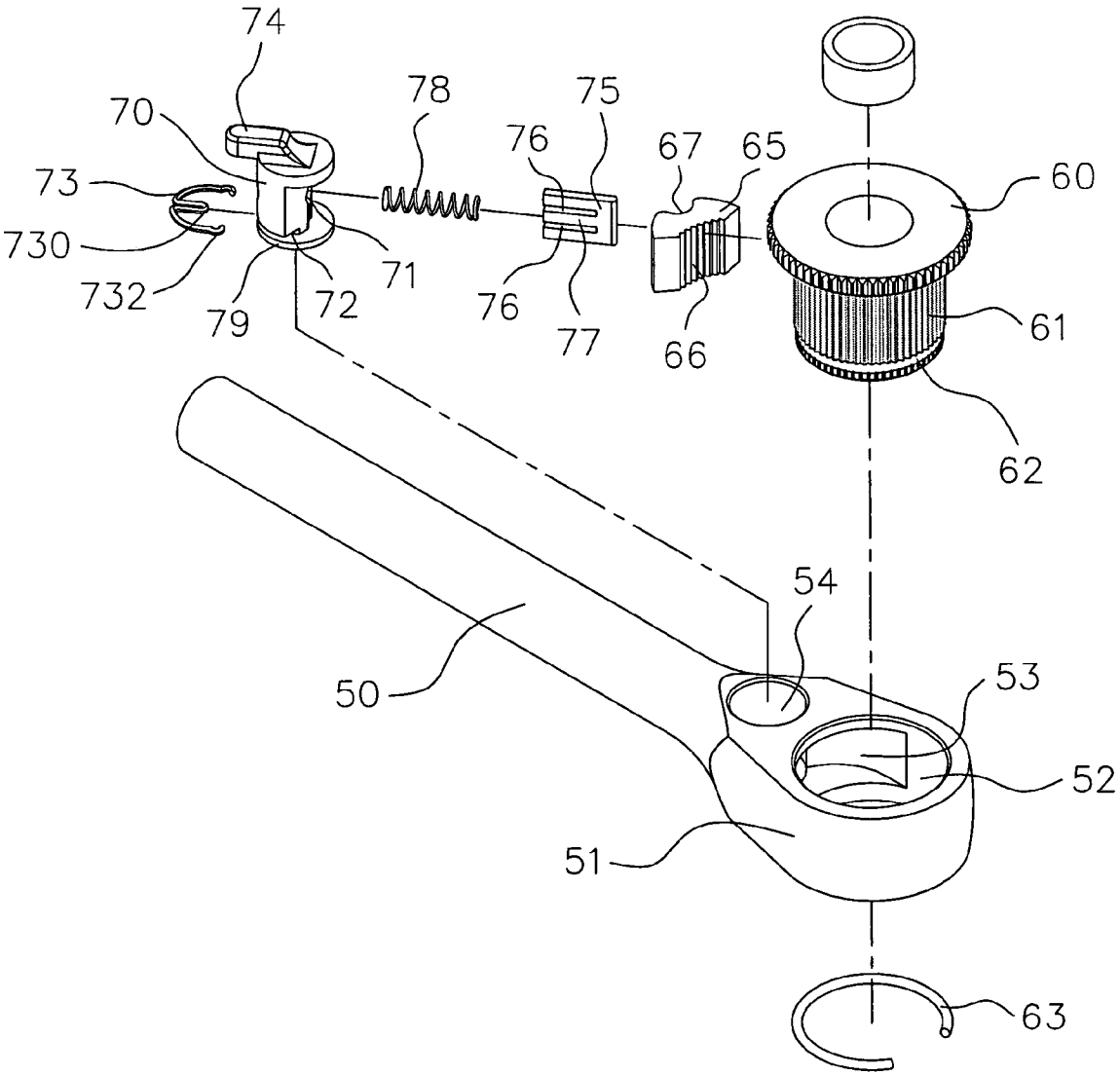
FIG. 3 is an exploded perspective view of a ratchet wrench in accordance with the preferred embodiment of the present invention.
Figure 5:
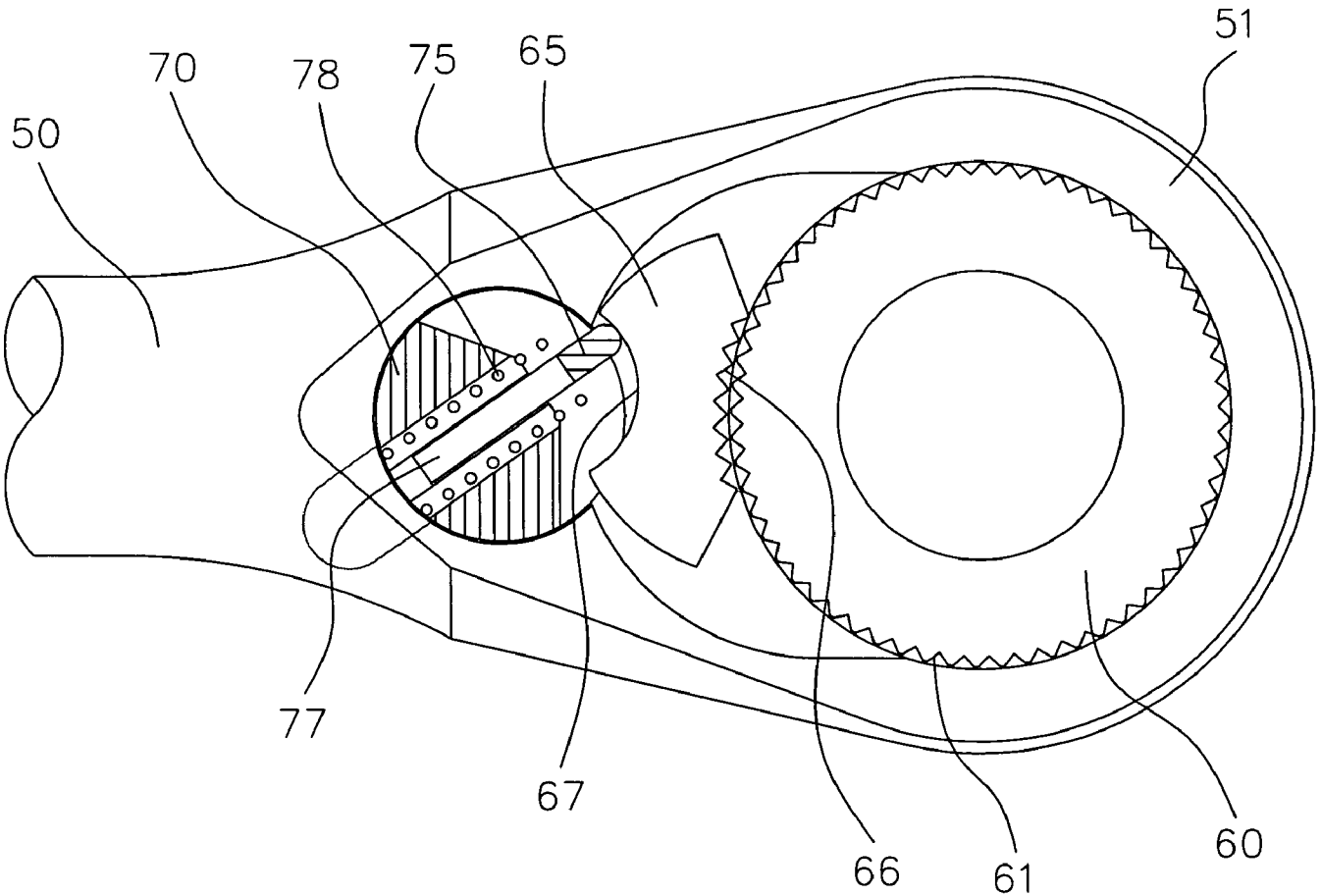
FIG. 5 is a partially cut-away top plan cross-sectional assembly view of the ratchet wrench as shown in FIG. 3.
Figure 6:
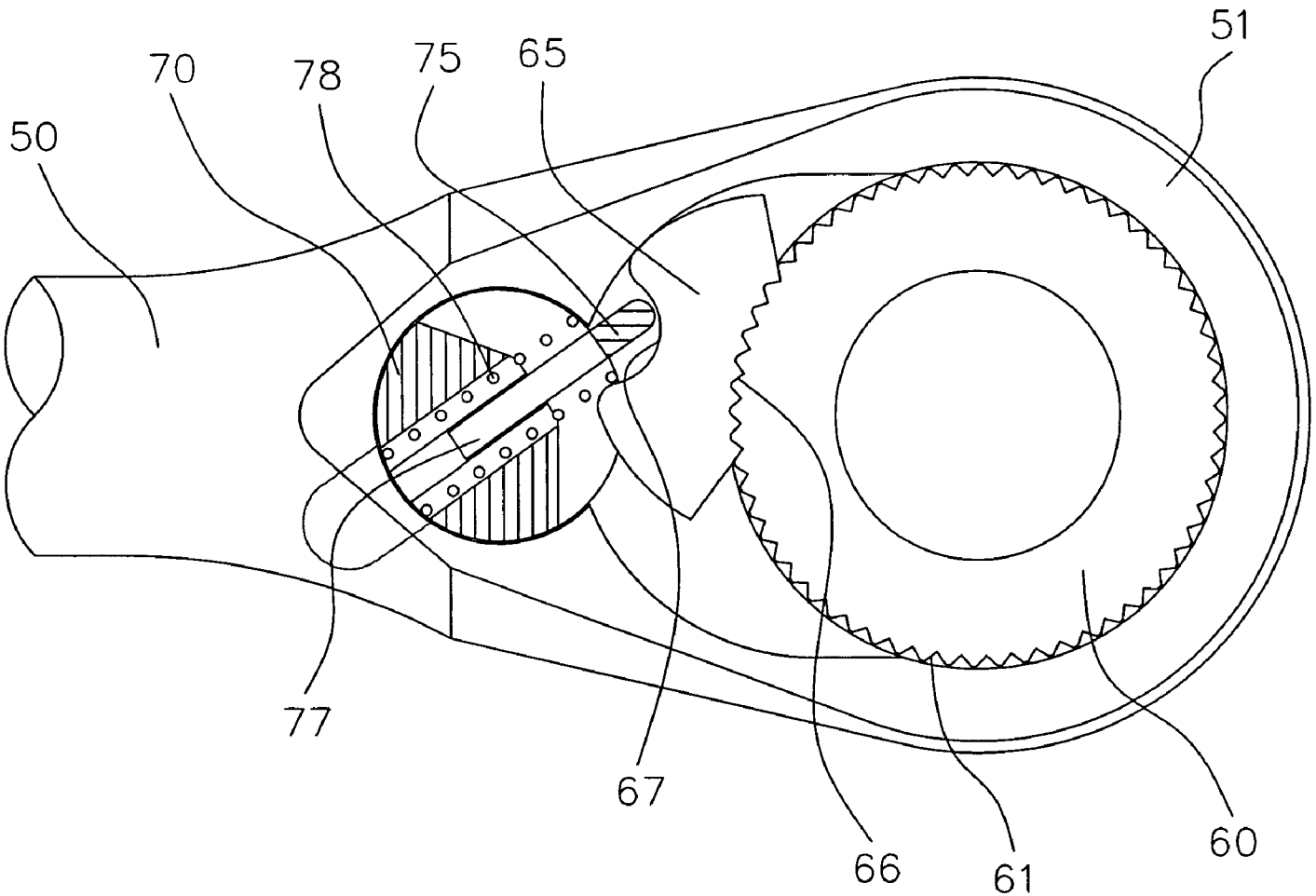
FIG. 6 is a schematic operational view of the ratchet wrench as shown in FIG. 5.

In operation, referring to FIGS. 5 and 6 with reference to FIGS. 3 and 4, the control knob 70 is rotated by the drive handle 74, so that the positioning plate 75 mounted on the control knob 70 is moved by rotation of the control knob 70 to push the pawl member 65 as shown in FIG. 5 to move into an included angle defined by the ratchet wheel 60 and the inner edge of the drive head 51 to lock the ratchet wheel 60 on the drive head 51 so as to control the drive direction of the ratchet wheel 60. Thus, the ratchet wheel 60 is rotated in one direction only when the drive head 51 is rotated so as to drive a workpiece (not shown) to rotate in one direction only.

Accordingly, the ratchet wrench includes a positioning plate 75 to push the pawl member 65, thereby reducing the volume of the ratchet wrench efficiently. In addition, the urging spring 78 is supported and guided by the guide shaft 77 of the positioning plate 75, so that the positioning plate 75 is not easily deformed, thereby facilitating movement of the urging spring 78 in the positioning plate 75. Further, the ratchet wrench only needs to provide a limit spring 73 to position the control knob 70 rigidly and stably, so that the ratchet wrench has a simplified construction, thereby decreasing costs of fabrication. Further, the positioning plate 75 is urged on the positioning edge 67 of the pawl member 65 rigidly and stably so as to position the pawl member 65 exactly. Further, the control knob 70 is rigidly and stably positioned in the receiving chamber 54 of the drive head 51 by the limit spring 73, thereby facilitating a user operating the control knob 70.

Figure 7:
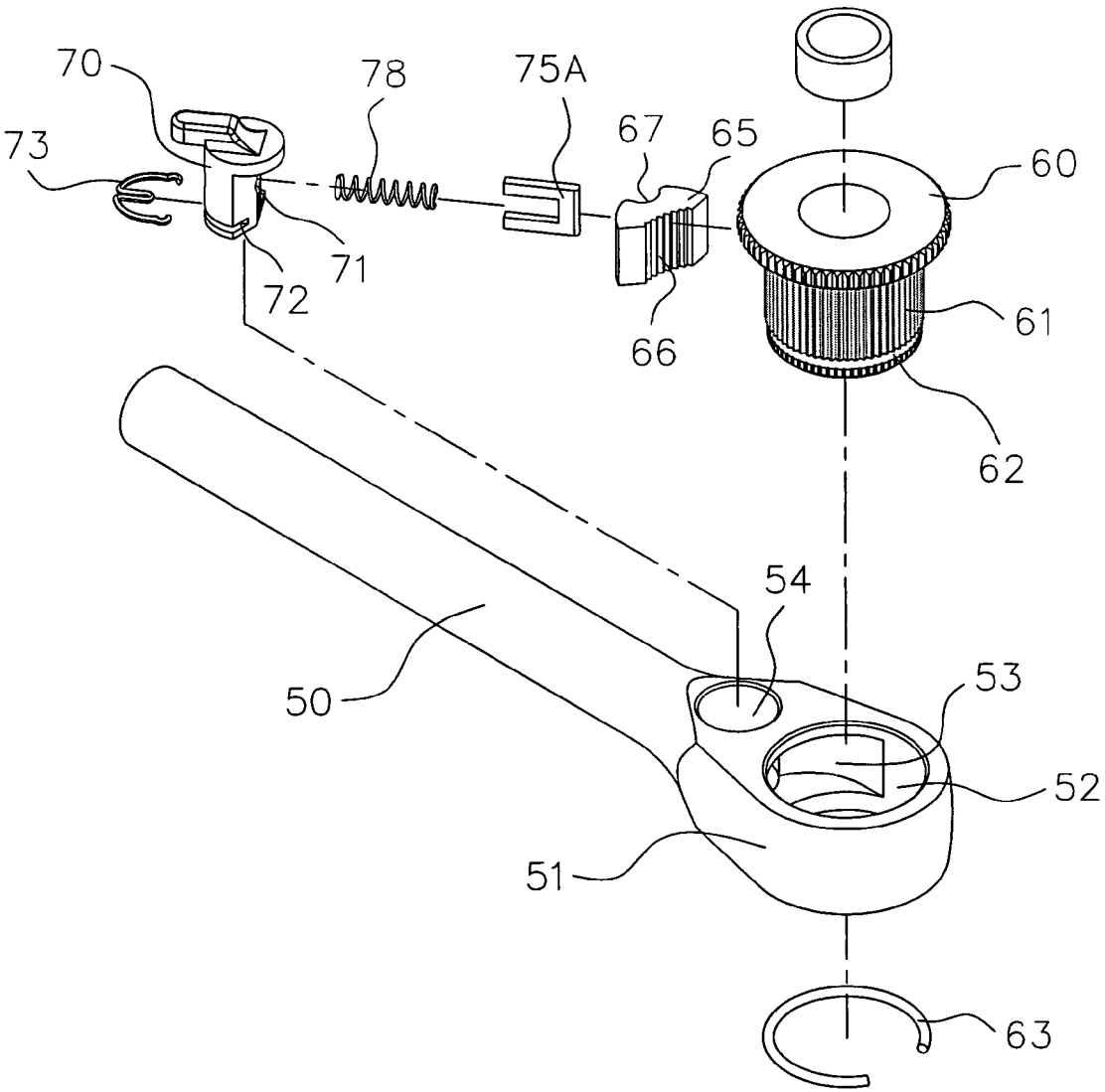
FIG. 7 is an exploded perspective view of a ratchet wrench in accordance with another embodiment of the present invention.
Figure 8:
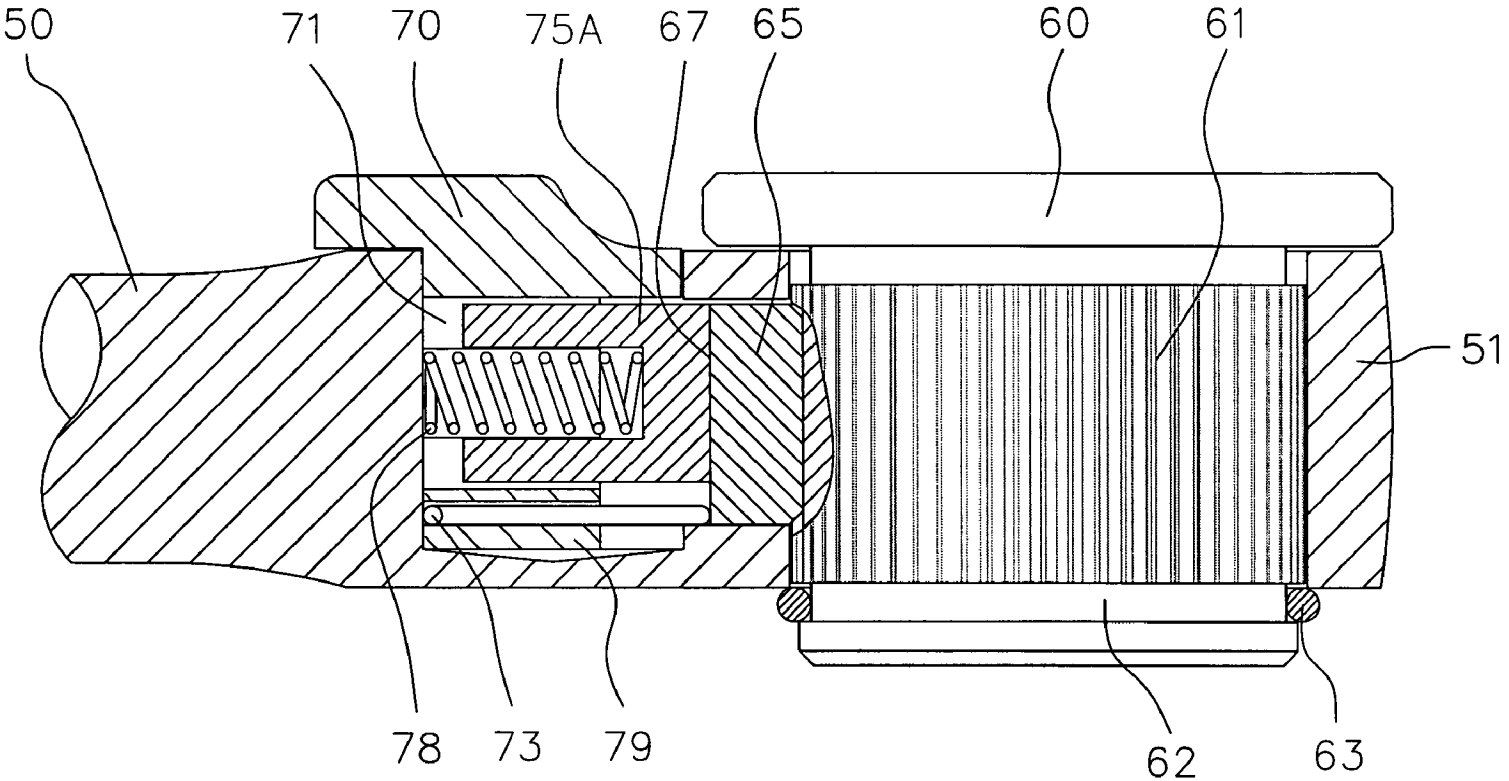
FIG. 8 is a partially cut-away plan cross-sectional assembly view of the ratchet wrench as shown in FIG. 7.

Referring to FIGS. 7 and 8, in accordance with another embodiment of the present invention, the positioning plate 75A has a sheet shape.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench, comprising:

a handle;

a drive head mounted on an end of the handle and having a first end formed with a receiving hole, a mediate portion formed with a receiving recess communicating with the receiving hole, and a second end formed with a receiving chamber communicating with the receiving recess;

a ratchet wheel mounted in the receiving hole of the drive head;

a pawl member pivotally mounted in the receiving recess of the drive head and engaged with the ratchet wheel;

a control knob rotatably mounted in the receiving chamber of the drive head and having an inside formed with a passage radially extended through the control knob;

a positioning plate mounted in the passage of the control knob and having a first end rested on the pawl member to push the pawl member to press the ratchet wheel; and an urging spring mounted on a second end of the positioning plate and urged between the positioning plate and the drive head;

wherein the positioning plate is substantially E-shaped.

2. The ratchet wrench in accordance with claim 1, wherein the second end of the positioning plate is formed with two slits and a guide shaft located between the two slits, and the urging spring is mounted on the guide shaft and located between the two slits.

3. The ratchet wrench in accordance with claim 1, wherein the pawl member has a side formed with an arcuate positioning edge, and the first end of the positioning plate is rested on the positioning edge of the pawl member.

4. The ratchet wrench in accordance with claim 3, wherein the passage of the control knob is aligned with the positioning edge of the pawl member.

5. A ratchet wrench, comprising:

a handle;

a drive head mounted on an end of the handle and having a first end formed with a receiving hole, a mediate portion formed with a receiving recess communicating with the receiving hole, and a second end formed with a receiving chamber communicating with the receiving recess;

a ratchet wheel mounted in the receiving hole of the drive head;

a pawl member pivotally mounted in the receiving recess of the drive head and engaged with the ratchet wheel;

a control knob rotatably mounted in the receiving chamber of the drive head and having an inside formed with a passage radially extended through the control knob;

a positioning plate mounted in the passage of the control knob and having a first end rested on the pawl member to push the pawl member to press the ratchet wheel; and an urging spring mounted on a second end of the positioning plate and urged between the positioning plate and the drive head;

wherein the second end of the positioning plate is formed with two slits and a guide shaft located between the two slits, and the urging spring is mounted on the guide shaft and located between the two slits.

6. The ratchet wrench in accordance with claim 5, wherein the positioning plate is substantially E-shaped.

7. The ratchet wrench in accordance with claim 5, wherein the urging spring is supported and guided by the guide shaft of the positioning plate.

8. The ratchet wrench in accordance with claim 5, wherein the pawl member has a side formed with an arcuate positioning edge, and the first end of the positioning plate is rested on the positioning edge of the pawl member.

9. The ratchet wrench in accordance with claim 8, wherein the passage of the control knob is aligned with the positioning edge of the pawl member.

* * * * *